US005945054A

United States Patent [19]

Meerman et al.

[11] Patent Number: 5,945,054

[45] Date of Patent: Aug. 31, 1999

[54] PROCESS FOR MANUFACTURING FILAMENTS FROM AN OPTICALLY ANISOTROPIC SPINNING SOLUTION

[75] Inventors: Johannes Jacobus Meerman, Arnhem; Erik Wilhelmus Maria Derksen, Didam; Peter Jeroen Cloos, Duiven, all of Netherlands

[73] Assignee: Akzo Nobel N.V., Netherlands

[21] Appl. No.: 09/063,766

[22] Filed: Apr. 21, 1998

Related U.S. Application Data

[63] Continuation of application No. PCT/EP96/04259, Sep. 24, 1996.

[30] Foreign Application Priority Data

Oct. 24, 1995 [NL] Netherlands ..... 1001487

[51] Int. Cl.[6] ..... D01D 5/06

[52] U.S. Cl. ..... 264/184

[58] Field of Search ..... 264/184

[56] References Cited

U.S. PATENT DOCUMENTS

| | | | |
|---|---|---|---|
| 4,308,374 | 12/1981 | Vollbracht et al. | 528/336 |
| 4,320,081 | 3/1982 | Lammers | 264/184 |

FOREIGN PATENT DOCUMENTS

| | | |
|---|---|---|
| 550684 | 9/1956 | Belgium . |
| 168879 | 1/1986 | European Pat. Off. . |
| 172001 | 2/1986 | European Pat. Off. . |
| 1102056 | 10/1955 | France . |
| 820948 | 11/1951 | Germany . |
| 60-65110 | 4/1985 | Japan . |

OTHER PUBLICATIONS

Derwent Patent Abstract 85–126242/21 (1985).

Translation of Japan 61–239,012 (1986).

*Primary Examiner*—Leo B. Tentoni

*Attorney, Agent, or Firm*—Richard P. Fennelly

[57] ABSTRACT

The invention pertains to a process for manufacturing filaments from an optically anisotropic spinning solution in which the spinning solution is extruded through spinning orifices grouped in at least one spinning section and the extrudates are passed through an inert gas and a coagulation bath in succession, with the ratio of the spacing of the spinning orifices to the width of the spinning section being more than 0.15 and less than 0.7, and the width of the spinning section being less than 5 mm. The invention makes it possible to spin a plurality of filaments of good physical properties at a high speed and a comparatively high acid concentration in the coagulant without widespread sticking.

13 Claims, 2 Drawing Sheets

PROCESS FOR MANUFACTURING FILAMENTS FROM AN OPTICALLY ANISOTROPIC SPINNING SOLUTION

The present application is a Continuation of International Application No. PCT/EP96/04259 filed Sep. 24, 1996.

BACKGROUND OF THE INVENTION

The invention pertains to a process for manufacturing filaments from an optically anisotropic spinning solution in which the spinning solution is extruded through spinning orifices grouped in at least one spinning section and in which the extrudates are passed through an inert gas and a coagulation bath in succession.

Such a process is known from Japanese Patent Publication No. 1986-239012, which describes a method of spinning filaments from poly(para-phenylene-terephthalamide), also termed "PPTA", where the filaments are spun through spinning orifices grouped to form a rectangle. The ratio of the rectangle's long side length to its short side length has to be at least 4. In the coagulation bath a hole, also rectangular, is provided beneath the spinning section. Since both the spinning section and the hole in the coagulation bath are rectangular, the bundle of filaments is rectangular also. As a result of this rectangular shape of the bundle, very few vortexes are created in the coagulant, a portion of which is discharged from the coagulation bath together with the filaments. This leads to a substantial reduction of filamentation in the coagulation bath (where the filaments are not yet fully coagulated) and makes it possible to increase the spinning speed.

In the Examples of said Japanese patent specification filaments of good strength are made. This strength is to be attributed first of all to the coagulant's low concentrations of sulfuric acid (0 and 10%) and the wideness, on average, of the spacing of the spinning orifices (the so-called "pitch"). The low acid concentration, which can only be maintained by treating the coagulant and replenishing it, and the large pitch, which makes it necessary to employ a large apparatus in relation to the number of produced filaments, make the described process into an expensive one with a very large waste stream.

Furthermore, at high spinning speeds there will have to be a subatmospheric pressure beneath the coagulation bath, this in order to further accelerate the speed of the coagulant and so reduce the tension in the filaments.

If in the process according to the Japanese patent specification the pitch of the spinning orifices is reduced in order to increase their number (and hence the number of filaments) per unit of area, the filaments in the coagulation bath will stick together at the spinning speeds mentioned, rendering the end product unsuitable for use in the envisaged high-grade applications (e.g., woven fabrics or composite reinforcement).

SUMMARY OF THE INVENTION

The invention has for its object to provide a process enabling the high-speed spinning (≧300 m/min) of a plurality of filaments having good to very good physical properties. This object is attained by the ratio of the spacing of the spinning orifices, the pitch, to the width of the spinning section in the process as described in the opening paragraph being more than 0.15 and less than 0.7, and the width of the spinning section being less than 5 mm.

Preferably, said ratio (which is easily calculated by dividing the pitch, in millimeters, by the width of the spinning section, also in millimeters) is in the range of 0.20 to 0.55, the spinning section has a width in the range of 1.5 to 4 mm, and the pitch is in the range of 0.3 to 0.7 mm. Also, the spinning section is preferably rectangular.

DESCRIPTION OF THE PREFERRED EMBODIMENTS

Figure 1:
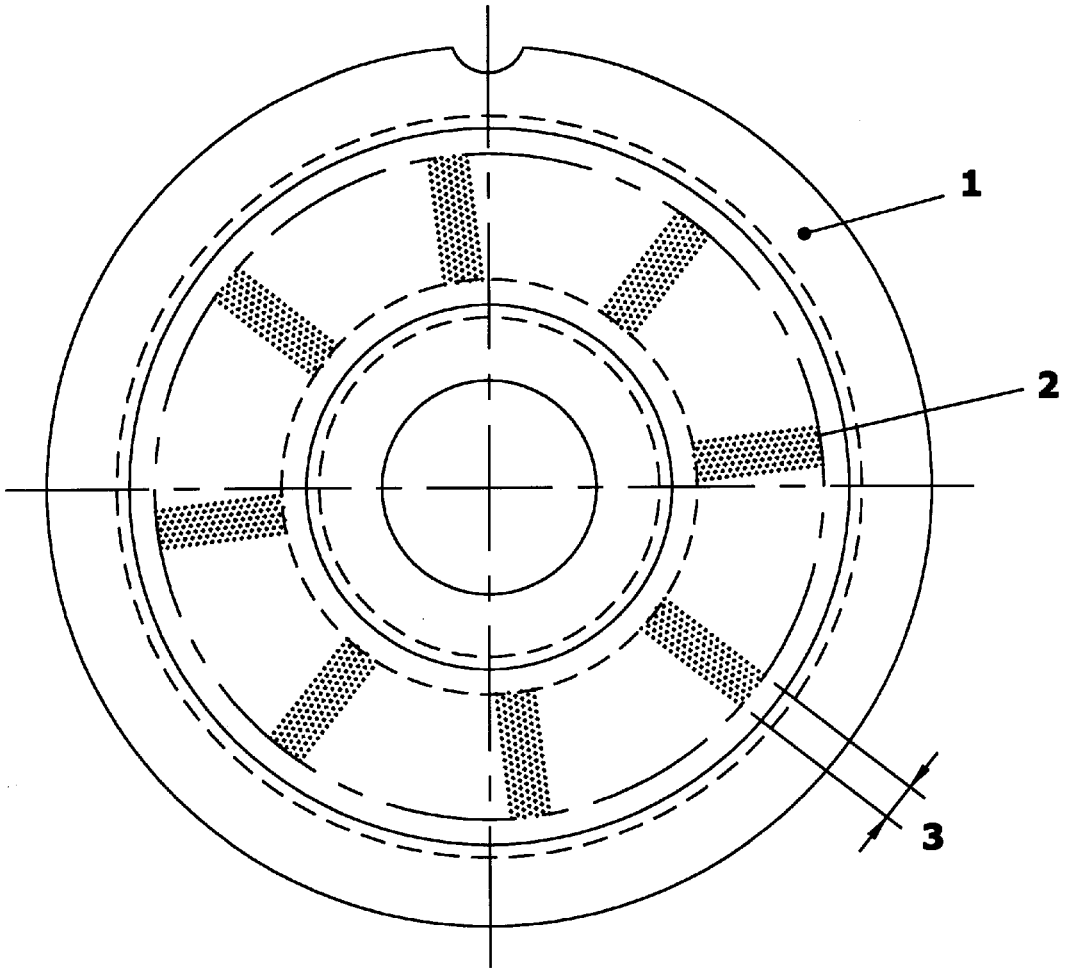

Surprisingly, it was found that using this process makes it possible to manufacture filaments having good physical properties at a small pitch (and hence a large number of filaments per unit of area) at a comparatively high acid concentration in the coagulation bath, resulting in an economical process with a small waste stream. As can be seen from the example, the number of stickings occurring during the process (from filaments making contact before there has been sufficient coagulation of the outer shell) is low.

The process according to the invention makes it possible to use a comparatively compact spinning apparatus or to equip existing spinning apparatus with spinneret plates with a higher number of spinning orifices. For instance, the production of an existing spinning apparatus can be increased from 1000 to 2000 or 3000 filaments per spinning position.

The favorable results are probably attributable to the low resistance experienced by the coagulant as it flows to the core of the filament bundle (alternatively, this may be referred to as high filament bundle permeability). The resistance depends on the route to be traveled, i.e., half of the width of the filament bundle, and the space between the various filaments (the pitch).

Preferably, the spinning orifices are grouped in more than one spinning section. The separate sections can then be positioned vis-a-vis one another such as to ensure the least possible hindrance of the coagulant's approaching flow and the fullest possible avoidance of disturbing the coagulation bath.

Also, the separate spinning sections preferably are positioned such that the maximum space between the outermost fibers is relatively small at the moment of extrusion from the spinning orifices of the different spinning sections, so that the convergence to, say, a guide may be low.

One highly effective way of positioning the rectangular spinning sections takes the form of the spinning sections being distributed equidistantly over a circle, with the longitudinal direction of each of the spinning sections coinciding with a radius. Such positioning hinders the approaching flow of the coagulant hardly (if at all) and gives a low convergence for each of the filament bundles.

To further reduce convergence in the filament bundle or filament bundles it is preferred to provide the bottom of the coagulation bath per spinning section with a rectangular opening which has a greater length than the spinning section and is somewhat narrower in width. In that case neither the length nor the width of the opening in the bottom of the coagulation bath will give rise to filament bundle convergence, and the filaments are prevented from being pressed together or suffering damage from scraping along the edge of the opening.

The physical properties of the filaments obtained by the process according to the invention can be enhanced still further by selecting a range for the distance traveled by the threadlike extrudates through the gaseous inert medium (the air gap) of more than 0.5 mm and less than 8 mm.

When very small air gaps are employed (say, smaller than 2 mm), there is a risk of the coagulant, which will always display some motion under the influence of the filament bundle (vibrations, small waves, etc.), making contact with the spinneret plate. When this happens, the process may be disturbed to such a degree as will require it to be stopped. Hence, if very small air gaps are to be used, it is of the essence to have the calmest possible coagulation bath surface. Surprisingly, it was found that the extent to which the coagulation bath surface is in motion is highly dependent on the geometry of the coagulation bath's bottom. If use is made of more than two spinning sections and a corresponding number of discharge openings in the bottom of the coagulation bath, the extent to which there is motion at the coagulant surface can be reduced substantially by introducing variations in height in or on the bottom. A very simple and effective embodiment of this is the one where the edges of adjacent openings are at different heights ("on different levels"). A possible explanation of this phenomenon is given below.

At the edges of the discharge openings the liquid which is entrained by the outgoing filament bundle is stopped or scraped off. Because of inertia, the liquid retains (part of) its speed and flows parallel to the bottom in the direction of the adjacent discharge opening. However, coagulant flow approaches also from the direction of this adjacent discharge opening, resulting in the collision of streams flowing in opposite directions. The liquid is pushed up as a result, and the coagulation bath surface rises above this stagnation point. Obviously, the damming up of the coagulant constitutes a significant restriction when selecting the air gap; after all, the coagulant has to be prevented from making contact with the spinneret plate.

When the aforementioned streams come together at different levels, the disclosed damming up does not arise. On the contrary, because the speed of one of the streams (i.e., the one flowing from the lowest edge) already has a component going in the direction of the liquid surface, there is extinction and the liquid surface remains calm.

When the coagulation bath has a depth of more than 10 mm and less than 20 mm (preferably less than 15 mm), on the one hand, the filaments encounter only slight resistance in the bath and the use of coagulant is low, and, on the other hand, the residence time in the coagulation bath is long enough to achieve the required coagulation.

It should be noted that European Patent Publication No.172,001 discloses a process for spinning aramid yarns in which use is made of rectangular spinning sections of narrow width and a small pitch. However, this process is substantially different from the process according to the invention, since the coagulant is not contained in a bath but supplied in the form of a waterfall. Because of the strong current in the waterfall and the small number of rows of filaments, the resistance encountered by the coagulant in the filament bundle does not play an essential part.

The process according to European Patent Publication No. 172,001 involves very high coagulant consumption. Moreover, in the examples only water (0% sulfuric acid) is employed. As a result, the (very large) stream of coagulant has to be subjected to extensive post-treatment and/or neutralization.

It should also be noted that in Japanese Patent Publication No. 1985-065110 a process is described which uses a spinneret plate having 20 spinning sections each with 50 spinning orifices. The pitch is 1.5 mm, giving a small number of filaments per unit of area.

The coagulant used in the process in question is water containing 0% or 10% of sulfuric acid, so this process is likewise attended with a large waste stream.

It is noted that French Patent No. 1,102,056 (filing date Jun. 16, 1947) discloses a very small spinneret with a large number of spinning orifices. Such spinnerets can only be used in true wet spinning processes, i.e., those spinning processes which do not comprise an air gap (for instance, viscose spinning) and wherein the extruded filaments are immediately contacted with the coagulant and coagulated. True wet spinning processes therefore are not confronted with filament sticking and problems occurring at the free surface of the coagulant. Further, in said publication it is prescribed that if the spinning orifices are grouped in spinning sections, the width of the groups should not exceed two orifices, whereas the invention allows greater widths.

European patent Publication No. 168,879 pertains to a process involving the use of two or more separate, spaced spinning sections. The sections according to this patent publication are rather large and filaments obtained with this process leave much to be desired in terms of mechanical properties and yarn regularity, especially if the process is carried out at high speed.

Within the framework of the invention the term pitch is used to indicate the average distance between the spinning orifice centers of adjacent spinning orifices.

The invention will be further illustrated below with reference to an Example and figures. Needless to say, the invention is illustrated but not limited by this Example.

FIG. 1: shows a bottom view of a spinneret according to the invention provided with eight rectangular spinning sections.

Figure 2:
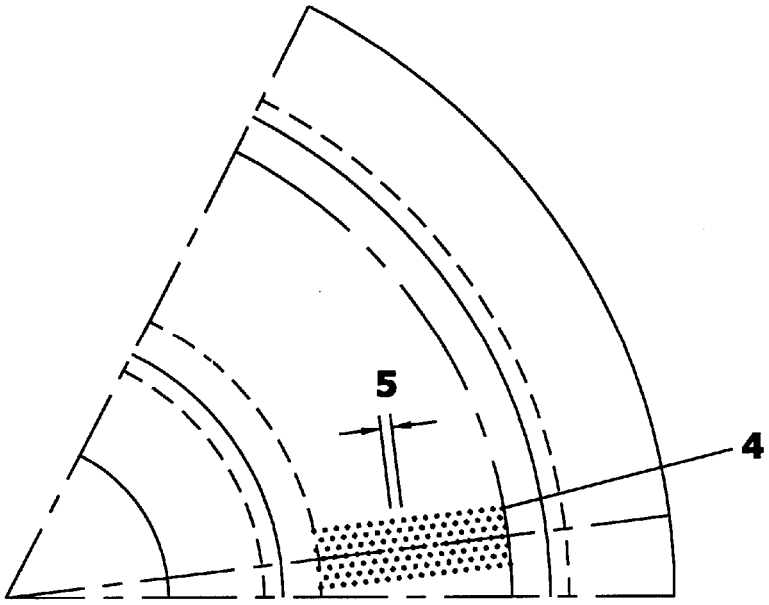

FIG. 2: shows two of the eight spinning sections of the spinneret according to FIG. 1 in greater detail.

Figure 3:
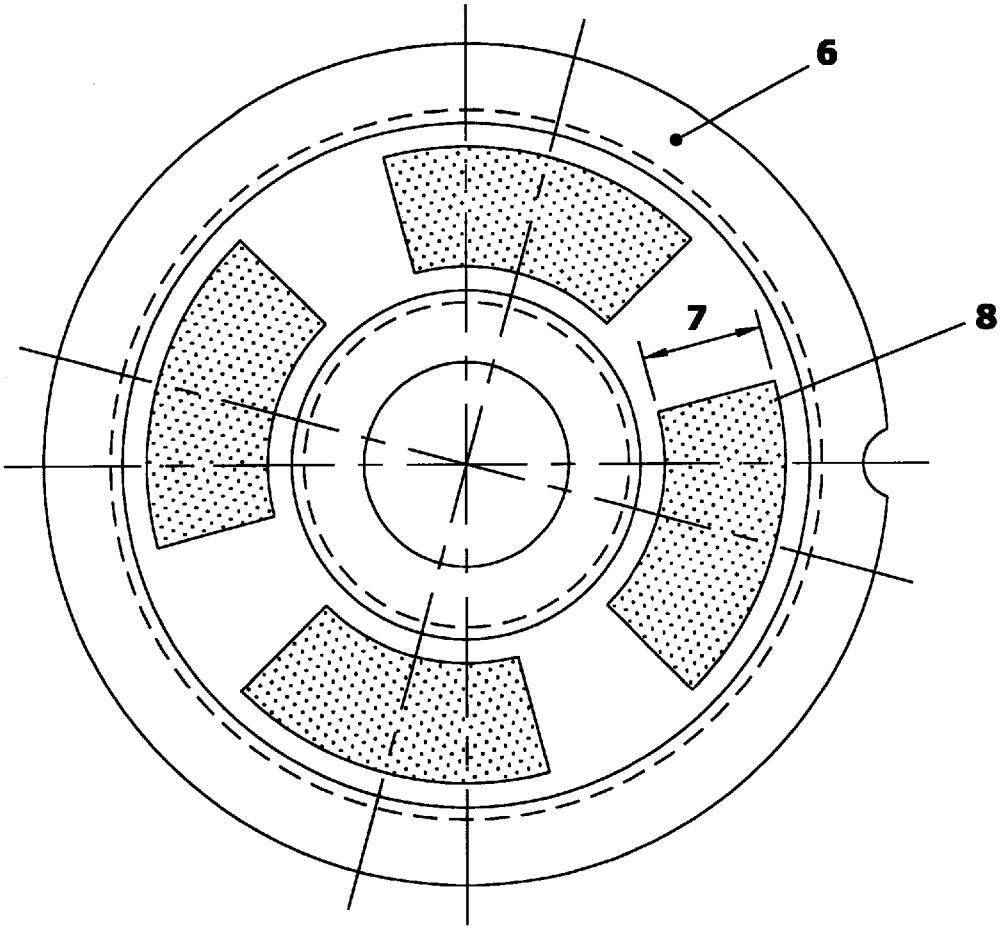

FIG. 3: shows a bottom view of a spinneret serving as comparative example.

Figure 4:
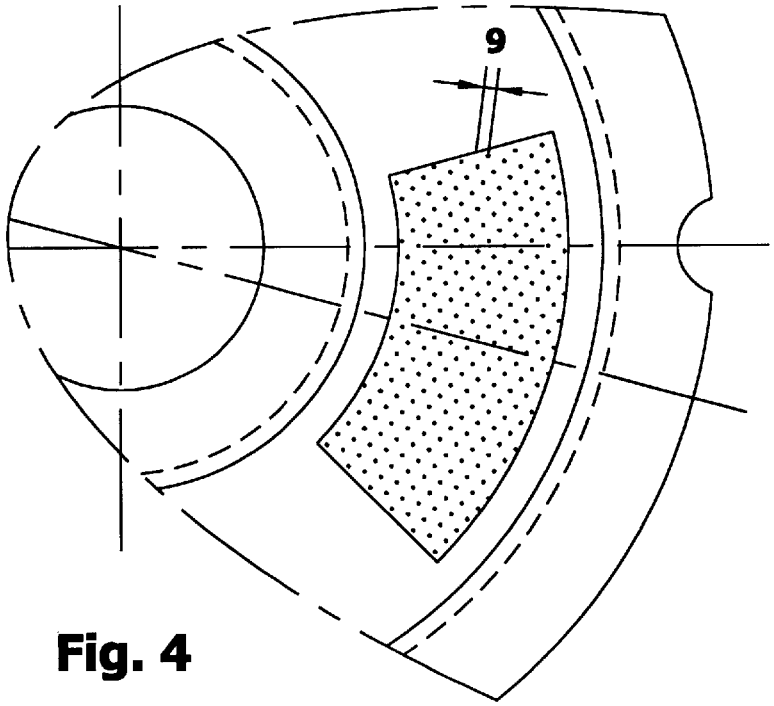

FIG. 4: shows one of the spinning sections of the spinneret according to FIG. 3 in greater detail.

EXAMPLE

In analogous manner to the procedure described in Example 6 of U.S. Pat. No. 4,308,374, poly(para-phenylene terephthalamide) was prepared using a mixture of N-methyl pyrrolidone and calcium chloride. After neutralization, washing, and drying, a polymer having an inherent viscosity of 5.4 was obtained.

The polymer was dissolved in sulfuric acid of 99.8% concentration in the manner described in Example 3 of U.S. Pat. No. 4,320,081. The thus prepared spinning solution had a polymer concentration of 19.4%.

The spinning solution was spun using different spinnerets.

A first circular spinneret 1, depicted in FIGS. 1 and 2, having an outer diameter of 57 mm (in the Table this spinneret is indicated with the code S1) was provided with eight rectangular spinning sections 2 (2.58 mm wide, indicated with 3 in FIG. 1, and 9 mm long) each having 125 spinning orifices 4. The spinning orifices 4 had a diameter of 65 $\mu$m and a distance of one to the other (pitch) 5 of 0.5 mm (the ratio of the pitch 5 to the width 3 of the spinning section 2 thus was 0.2).

A second circular spinneret 6, depicted in FIGS. 3 and 4 (in the Table this spinneret is indicated with the code S2), serving as a comparative example, had an outer diameter of 57 mm and was provided with four spinning sections 8 (having a constant width 7 of 9.5 mm) each following the curve of the circumference of the circular spinneret and each comprising 250 spinning orifices. The spinning orifices had a diameter of 65 $\mu$m and a distance of one to the other 9 of 1.0 mm (the ratio of the pitch 9 to the width 7 of the spinning section 8 thus was 0.11).

The spinning solution was spun through an air gap, as indicated in the Table. The same-level or flat bottom of the coagulation bath (having a depth of 10 mm) was provided with eight and four openings, respectively (S1: rectangular 2.0 mm×15 mm; S2: circular with a diameter of 5 mm) each positioned directly beneath a spinning section.

The coagulant was made up of water having a sulfuric acid concentration of 20% and a temperature of 10° C. The spinning speeds and the draw ratios are indicated in the Table. The physical properties were determined in accordance with ASTM D885.

The term "fluffs" is used to indicate various irregularities (resulting from breaks, filament lapping around rolls, etc.) in the manufactured yarn. The degree of sticking was evaluated visually with 1 indicating that there was little or no sticking (less than 1% of the filaments subject to sticking) and 5 indicating a very strong degree of sticking (over 25% of the filaments subject to sticking).

TABLE

| Spinning rate (m/min) | | 300 | 400 | 300 | 400 | 300 |
|---|---|---|---|---|---|---|
| Draw ratio | | 7.1 | 9.5 | 7.1 | 9.5 | 7.1 |
| | | Tenacity (mN/tex): | | Fluffs per 15 min): | | Sticking (–): |
| Spinneret S1 | | | | | | |
| Airgap: | 3 mm | 2218 | 2162 | 0 | 1 | 1 |
| | 4 mm | 2179 | 2143 | 1 | 0 | 1 |
| | 6 mm | 2181 | 2177 | 0 | 0 | 1 |
| | 8 mm | 2158 | 2032 | 2 | 1 | 1 |
| Spinneret S2 | | | | | | |
| Airgap: | 8 mm | 1912 | 1879 | 5 | 40 | 4 |
| | 8 mm | 1864 | 1873 | 1 | 34 | 4 |
| | 8 mm | 1902 | 1955 | 5 | 33 | 4 |
| | 8 mm | 1921 | 1953 | 4 | 6 | 4 |

The filaments manufactured using S1 have significantly higher tenacity than those made using S2. Also, the amount of sticking is far lower. Furthermore, in view of the available space, the number of spinning sections in a spinneret such as S1 can be increased to, say, 12 or 16, whereas S2 provides no such opportunity.

A third circular spinneret (S3; this spinneret, unless specified otherwise, corresponds to S1) having an outer diameter of 75 mm was provided with eight rectangular spinning sections (2.58 mm wide and 18 mm long) each having 250 spinning orifices, giving 2000 filaments in all. The spinning orifices had a diameter of 65 $\mu$m and were spaced 0.5 mm apart.

Spinneret S3 was used to spin the spinning solution described above (under conditions which, unless specified otherwise, correspond to those disclosed above) employing an air gap of 6 mm and a spinning speed of 300 m/min. The resulting yarn had a tenacity of 2202 mN/tex. The number of fluffs per 15 minutes was 4, and there was no sticking.

We claim:

1. A process for manufacturing filaments from an optically anisotropic spinning solution in which the spinning solution is extruded through spinning orifices grouped in at least one spinning section and the extrudates are passed through an inert gas and a coagulation bath in succession, characterized in that the ratio of the spacing of the spinning orifices to the width of the spinning section is more than 0.15 and less than 0.7, and the width of the spinning section is less than 5 mm.

2. A process according to claim 1, characterized in that the spinning orifices are grouped in more than one spinning section.

3. A process according to either claim 1 or claim 2, characterized in that the spinning section or spinning sections are rectangular.

4. A process according to claim 3, characterized in that the spinning orifices are grouped in more than one spinning section and are distributed equidistantly over a circle, and the longitudinal direction of each of the spinning sections coincides with a radius.

5. A process according to either claim 1 or claim 2, characterized in that the spinning section or spinning sections are rectangular and the bottom of the coagulation bath is provided per spinning section with a rectangular opening which has a greater length than the spinning section and is narrower in width.

6. A process according to claim 4, characterized in that the bottom of the coagulation bath is provided per spinning section with a rectangular opening which has a greater length than the spinning section and is narrower in width.

7. A process according to claim 5, characterized in that the bottom of the coagulation bath is provided per spinning section with a rectangular opening which has a greater length than the spinning section and is narrower in width.

8. A process according to claim 6, characterized in that the bottom of the coagulation bath is provided per spinning section with a rectangular opening which has a greater length than the spinning section and is narrower in width.

9. A process according to claim 7, characterized in that the bottom of the coagulation bath is provided with at least two openings, and the adjacent edges of adjacent openings are at different levels.

10. A process according to claim 8, characterized in that the bottom of the coagulation bath is provided with at least two openings, and the adjacent edges of adjacent openings are at different levels.

11. A process according to any one of claims 1–2, 4, and 6–10, characterized in that the distance traveled by the threadlike extrudates through the gaseous inert medium is more than 0.5 mm and less than 8 mm.

12. A process according to any one of either claim 1 or claim 2, characterized in that the spinning section or spinning sections are rectangular and the distance traveled by the threadlike extrudates through the gaseous inert medium is more than 0.5 mm and less than 8 mm.

13. A process according to either claim 1 or claim 2, characterized in that the spinning section or spinning sections are rectangular and the bottom of the coagulation bath is provided per spinning section with a rectangular opening which has a greater length than the spinning section and is narrower in width and the distance traveled by the threadlike extrudates through the gaseous inert medium is more than 0.5 mm and less than 8 mm.

* * * * *